United States Patent [19]

Uehara et al.

[11] 4,233,935

[45] Nov. 18, 1980

[54] MAGNETIC BRUSH APPARATUS FOR ELECTROSTATIC PRINTING SYSTEM

[75] Inventors: Tsutomu Uehara, Yokosuka; Toshihiko Oguchi, Kawasaki; Tsutomu Kubo, Yokohama; Yukio Suzuki, Ayase, all of Japan

[73] Assignee: Tokyo Shibaura Denki Kabushiki Kaisha, Kawasaki, Japan

[21] Appl. No.: 1,003

[22] Filed: Jan. 4, 1979

[30] Foreign Application Priority Data

Jan. 14, 1980 [JP] Japan ..... 53-3052

[51] Int. Cl.[3] ..... G03G 15/09

[52] U.S. Cl. ..... 118/657; 118/658; 355/3 DD

[58] Field of Search ..... 355/3 DD; 96/1 SD; 427/18, 47; 346/74.1; 118/657, 658; 430/122

[56] References Cited

U.S. PATENT DOCUMENTS

| | | | |
|---|---|---|---|
| 3,858,514 | 1/1975 | Beebe et al. | 346/74.1 |
| 3,962,992 | 6/1976 | Takagi et al. | 118/623 X |
| 4,081,571 | 3/1978 | Nishihama et al. | 427/18 |

FOREIGN PATENT DOCUMENTS

| | | | |
|---|---|---|---|
| 2810520 | 9/1978 | Fed. Rep. of Germany | 355/3 DD |
| 50-37548 | 12/1975 | Japan . | |
| 52-146641 | 12/1977 | Japan . | |
| 53-132 | 1/1978 | Japan . | |

*Primary Examiner*—Evan K. Lawrence

*Attorney, Agent, or Firm*—Cushman, Darby & Cushman

[57] ABSTRACT

A magnetic brush apparatus is provided with a hopper for supplying powdered one-component magnetic developer to a cylindrical sleeve housing a rotating magnet roller with a number of magnetic poles. The powdered magnetic toner supplied onto the sleeve surface is formed into a magnetic brush on the sleeve surface under control of alternating magnetic field generated by the magnet roller. The magnet brush is carried around the sleeve surface with rotation of the magnet roller. Outside the sleeve surface a predetermined distance is positioned a magnetic member which may be attached to the tip end of a doctor blade. The magnetic member disturbs the alternating magnetic field on the sleeve surface, thereby restricting the height of the powdered developer passing between the end of the magnetic member and the sleeve surface.

7 Claims, 1 Drawing Figure

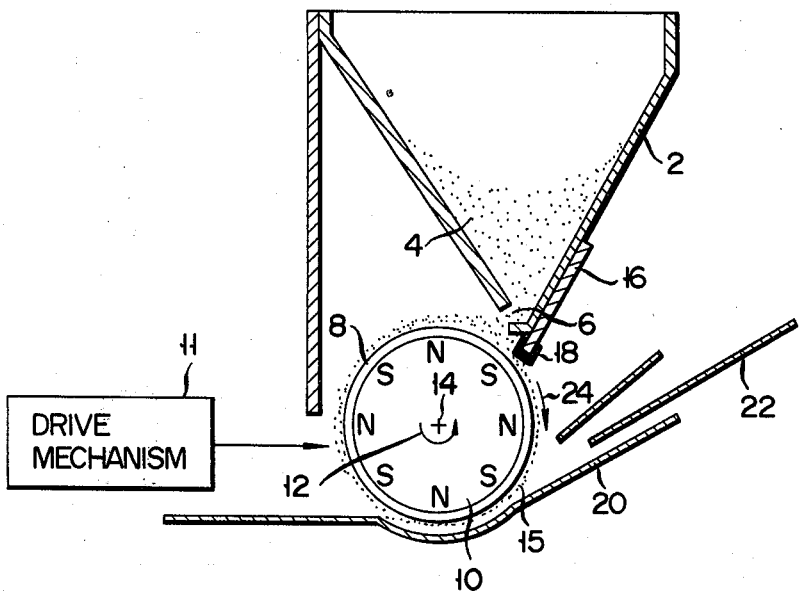
DRIVE
MECHANISM
11
12
14
8
N
S
S
N
N
S
S
N
2
4
16
6
18
24
22
20
15
10

MAGNETIC BRUSH APPARATUS FOR ELECTROSTATIC PRINTING SYSTEM

BACKGROUND OF THE INVENTION

The present invention relates to a magnetic brush apparatus for an electrostatic printing system and, more particularly, to a magnetic brush apparatus for forming a magnetic brush by a developer called one-component developer.

Two types of the magnetic brush apparatuses are known. One of them is of the type to form a magnetic brush by using a developer mixture called a two component developer, which is composed of powdered developer or toner and magnetic carrier such as powdered iron. The other is of the type to form the same by the powdered developer called a one-component developer, which is composed of powdered toner containing magnetic particles covered with resin which is colored by agent. The magnetic brush apparatus of this kind comprises a hopper which containes the developer and supplies the developer, a tubular sleeve which is made of nonmagnetic material and is supplied at the surface with developer, a magnetic roller which produces a magnetic field on the sleeve surface to form a magnetic brush and a doctor blade for defining the height of a magnetic brush formed on the sleeve surface to be at a predetermined level. With rotation of either the magnetic roller or the sleeve, the magnetic brush of a fixed heigh in transfered and is contacted with a photosensitive layer of photoconductive paper on which an electrostatic latent charge image is formed.

The magnetic brush apparatus of the one-component type and the two-component type, which are about the same in the construction, suffer from the following disadvantages. In the two-component type magnetic brush apparatus, the life time of the developer is relatively short so that the worn developer must be replaced by a new one at which a given number of sheet is copied. On the other hand, the one-component type magnetic brush apparatus has not such a disadvantage but has the following disadvantages. In this type apparatus, the magnetic brush formed is thin and uneven, compared to the two-component type apparatus. For this, the distance between the sleeve and photoconductive paper must be selected to be narrow and an amount of the developer supplied must always be controlled optimum. Therefore, the doctor blade in the magnetic brush apparatus using the one-component developer is more important than that in the magnetic brush apparatus. In the two-component developer, the size of each toner particle is $3\sim20$ $\mu\phi$ and the size of each carrier particle is $50\sim150$ $\mu\phi$. The magnetic brush may be formed by relatively large particles and further the distance between the tip of the doctor blade and the sleeve is usually relatively long, e.g. $3\sim5$ mm. Therefore, mere passing of the magnetic brush through a space between the doctor blade and the sleeve can provide a given height of the magnetic brush.

On the other hand, in the one-component developer the size of each toner particle is relatively small, for example, $5\sim25\mu$. The magnetic brush is formed by relatively small particles. The distance between the tip of the doctor blade and the sleeve must be precisely selected to be 0.3 to 0.5 mm. If the magnetic brush properly passes through a space between the doctor blade and the sleeve, that is to say, the magnetic brush is properly scraped off the magnetic brush must be controlled to have a proper height. In fact, the space is narrower and the developer particle is small in diameter and further the developer is of one-component type. Because of this, the transferring developer particles colligate to each other becoming solidified and staying at the solidified location. As a result, the space between the doctor blade and the sleeve is closed. Further, the height of the magnetic brush formed is uneven or the amount of the transferring developer particles unstably varies. In the case of the one-component type apparatus, it is very difficult to obtain a uniform level of the magnetic brush height by scraping off the magnetic brush formed.

SUMMARY OF THE INVENTION

Accordingly, an object of the present invention is to provide a magnetic brush apparatus which may precisely control the height of a magnetic brush formed by magnetic powdered toner at a given level, while preventing the magnetic powdered toner from being solidified.

According to the present invention, there is provided a magnetic brush apparatus comprising: means for supplying a powdered one-component developer composed of particles, each including a magnetic material, a tubular sleeve made of non-magnetic material of which the surface is supplied with powdered developer from said means;

a rotatable magnet roller with a number of magnet poles which is disposed within said tubular sleeve; and a magnetic member of which the tip end is disposed outside said sleeve surface by a given distance.

The magnetic member changes a distribution of a magnetic field formed on the sleeve by means of the magnetic roller. The magnetic brush formed by magnetic powdered toner formed on the sleeve is carried with rotation of either the magnetic roller or the sleeve. The amount of the magnetic brush currently being transferred is controlled in a magnetic field area disturbed by the magnetic member. As a result, the height of the magnetic brush is automatically controlled at a given level through the movement of the magnetic toner particles forming the magnetic brush, without mechanically scraping away the magnetic brush.

Other objects and features of the invention will be apparent from the following description taken in connection with the accompanying drawing, in which:

BRIEF DESCRIPTION OF THE DRAWING

The FIGURE schematically shows a cross sectional view of an embodiment of a magnetic brush apparatus according to the invention.

DETAILED DESCRIPTION OF THE PREFERRED EMBODIMENT

In the FIGURE, illustrating a magnetic brush apparatus according to the invention, a hopper 2 contains magnetic toner or magnetic developer 4 therein. Each particle of the magnetic toner 4 is 5 to 25 $\mu\phi$ in size, 43 emu/g in saturation magnetization, 8 emu/g in residual magnetization, 260 Oe in coercive force $10^{-6}$ mho/cm in conductivity (under 100 V/cm of applied electric field). Under an opening 6 of the hopper 2 for supplying a magnetic toner is disposed a tubular sleeve 8 made of non-magnetic material such as aluminium. Within the sleeve 8 is disposed a cylindrical magnetic roller 10 rotatable in a direction of an arrow 12. The magnetic roller 10 is provided with 8 poles of which each pair is disposed symmetrically with respect to an axis 14, as shown, and is driven at 600 rpm, for example, by a drive mechanism 11. The sleeve 8, in place of the magnet roller 10, may be driven by the drive mechanism 11. The rotational direction of the magnet roller 10 is not limited to the direction of arrow. The opposite rotational direction to the arrow is, of course, permitted. The magnetic flux density on the surface of each pole of the magnet roller 10 is 800 Gauss, for example. A magnetic field generated on the sleeve surface by the magnet roller 10 distributes magnetic toner particles over the sleeve surface in accordance with the magnetic field, thereby forming a magnetic brush 15. The hopper 2 is provided at the side with a doctor blade 16 of which the tip is disposed on the surface of the sleeve 8. As shown, the tip of the doctor blade 16 is provided with a magnetic member 18 to substantially restrict the height of the magnetic brush. Conventionally, the doctor blade 16 is made of non-magnetic material so as not to disturb the magnetic field on the sleeve 8. Conversely, according to this invention, the magnetic material 18 is dispossed above the sleeve so as to disturb the magnetic field positively by using magnetic material. In this example, a magnetic member 18 is attached to the tip of the doctor blade 16 to disturb the magnetic field in the vicinity of the tip of the doctor blade 16. Alternately, the doctor blade 16 per se may be made of magnetic material. Additionally, the magnetic member 18 may be disposed in the vicinity of the tip of the doctor blade, not directly mounted on the tip thereof. The magnetic member 18 is preferably made of material having high permeability, relatively small coersive force and residual magnetic flux density, such as iron, cobalt, nickel, alloy of these metals, alloy of these metal and silicon, aluminum or other metal, or oxide of these metal and the alloy. The distance from the surface of the sleeve 8 to the magnetic member 18 is selected equal to 2 mm or below 2 mm. The distance is about 1 mm when the height, or the thickness of the magnetic brush is after passing the space between the magnetic member 18 and the sleeve 8, is approximately 0.5 mm. The magnetic member 18 in fact comes in contact with the magnetic toner but this contact is not directed to the scraping-off of the magnetic toner. The controlling of the height of the toner to be at a given level results from changing the movement of toner particle due to the magnetic field disturbed by the magnetic member 18. The height of the magnetic brush has a given relation with the distance between the magnetic member 18 and the sleeve 8. It is not necessary to make the former equal to the latter. The doctor blade in this embodiment is used to mount the magnetic member thereto and to prevent toner particles from passing above the magnetic member 18.

A guide member 20 extends from one side of the sleeve 8 to the other side, after passing under the same. The photoconductive paper 22 enters from one side of the guide member 20 into a space between the bottom part of the sleeve 8 and the guide member 20 where the paper 22 contacts the magnetic brush 15, and then leaves the space, as shown. The magnetic brush 15 may be contacted with a drum having a photoconductive layer in place of the photoconductive paper 22.

The magnetic toner, i.e. the magnetic brush of one-component developer, on the sleeve 8 is transferred in an opposite direction as indicated by an arrow 24 to the rotational direction as indicated by an arrow 12 of the magnet roller 10. After passing the space between the doctor blade 16 and the sleeve 8, for example 1 mm, the magnetic brush is shaped to have a given height. Which is shorter than the space, for example 0.5 mm, is continuously transfered to the space between the sleeve 8 and the guide member 20. The reason why the 1 mm space controls the height of the magnetic brush to be 0.5 mm is as follows.

Each magnetic toner particle of the magnetic brush 15 is rolled and transfered by change of the magnetic field on the sleeve 8. So long as the magnetic field periodically changes, an equal amount of magnetic toner particles is transferred. When the magnetic member 18 is mounted on the tip of the doctor blade 16, the magnetic field in the vicinity of the doctor blade 16 becomes remarkably different from that in the other space. For this, the transferring speed of the magnetic brush slows down to restrict an amount of the toner particles being carried. In the vicinity of the magnetic member 18, some magnetic toners, are constantly vibrated and rolled. For this, magnetic toner particles, which otherwise tend to colligate or stick to each other in the vicinity of the doctor blade 16, does not do so.

Even when the sleeve 8 is rotated while the magnetic roller 10 is fixed, the magnetic brush is transfered to the rotational direction of the sleeve 8 so that the height of the magnetic brush is defined to be shorter than the interval between the doctor blade 16 and the sleeve 8, for a similar reason. Further, it is prevented that the magnetic toner particles colligate and stick to the doctor blade 16. Preferably, the doctor blade 16 is slidable so as to adjust the interval between the tip thereof and the sleeve 8. As mentioned above, the distance between the doctor blade 16 and the sleeve 8 is not equal to the height of the magnetic brush 15. However, through the adjustment of the distance, the magnetic field is changed and hence the height of the magnetic brush is adjusted.

The charging method of magnetic toner and the transfer onto the photoconductive paper 22, which have not been described in the above example, should be referred to U.S. Pat. No. 3,909,258.

As described above, the height of the magnetic brush can be precisely controlled at a given level. Further, since the magnetic toner particles vibrate near the magnetic member, it is prevented that the powdered toner particles are colligated and stay there.

What we claim is:

1. A magnetic brush apparatus comprising:

means for supplying a powdered one-component developer composed of particles each including a magnetic material;

a tubular sleeve made of non-magnetic material the surface of which is supplied with powered developer from said supplying means;

a rotatable magnet roller with a number of magnet poles which is disposed within said tubular sleeve;

drive means for rotating said magnet roller in one direction, said rotating magnet roller forming an alternating magnetic field on the surface of said tubular sleeve thereby carrying said powered one-component developer around the surface of said tubular sleeve; and means for restricting the height of said powdered developer to a predetermined level, including a magnetic member one end of which is disposed outside said sleeve surface a predetermined distance such that said developer passes between said one end of the magnetic member and said sleeve surface, said magnetic member disturbing the alternating field on the sleeve surface, thereby restricting the height of said powdered developer moving past said one end of the magnetic member to said predetermined level.

2. A magnetic brush apparatus according to claim 1, wherein the distance between said magnetic member and said sleeve surface is not longer than 2 mm.

3. A magnetic brush apparatus according to claim 1, wherein said magnetic member is made of ferromagnetic material.

4. A magnetic brush apparatus according to claim 1, further comprising a doctor blade having a tip disposed apart from the sleeve surface.

5. A magnetic brush apparatus according to claim 1, further comprising a doctor blade of which the tip is disposed apart from the sleeve surface, said doctor blade having said magnetic member attached thereto.

6. A magnetic brush apparatus according to claim 1, wherein said magnetic member is slidable so as to adjust the interval between the tip thereof and said sleeve.

7. A magnetic brush apparatus according to claim 1, further comprising second drive means for rotating said sleeve.

* * * * *

Notice of Adverse Decision in Interference

In Interference No. 100,831, involving Patent No. 4,233,935, T. Uehara, T. Oguchi, T. Kubo and Y. Suzuki, MAGNETIC BRUSH APPARATUS FOR ELECTROSTATIC PRINTING SYSTEM, final judgment adverse to the patentees was rendered Oct. 8, 1982, as to claims 1–4 and 7.

[*Official Gazette Feb. 1, 1983.*]